US012702210B2

(12) United States Patent
Anderson

(10) Patent No.: US 12,702,210 B2
(45) Date of Patent: Aug. 11, 2026

(54) PROTECTIVE CASE FOR A COLLECTIBLE CARD

(71) Applicant: Clint Anderson, Giffod, IL (US)

(72) Inventor: Clint Anderson, Giffod, IL (US)

( * ) Notice: Subject to any disclaimer, the term of this patent is extended or adjusted under 35 U.S.C. 154(b) by 0 days.

(21) Appl. No.: 18/674,905

(22) Filed: May 26, 2024

(65) Prior Publication Data

US 2024/0324743 A1 Oct. 3, 2024

Related U.S. Application Data

(60) Provisional application No. 63/492,308, filed on Mar. 27, 2023.

(51) Int. Cl.

| | |
|---|---|
| ***A45C 11/18*** | (2006.01) |
| ***A45C 13/10*** | (2006.01) |
| ***B65D 21/02*** | (2006.01) |

(52) U.S. Cl.

CPC ..... *A45C 11/18* (2013.01); *A45C 13/1069* (2013.01); *B65D 21/022* (2013.01)

(58) Field of Classification Search

CPC .... A45C 11/18; A45C 13/1069; B65D 21/022
USPC ..... 206/454
See application file for complete search history.

(56) References Cited

U.S. PATENT DOCUMENTS

| | | | | |
|---|---|---|---|---|
| 4,979,619 | A * | 12/1990 | Hager | A45C 11/18 150/147 |
| 5,040,671 | A | 8/1991 | Hager | |
| 5,577,609 | A * | 11/1996 | Hexter, Jr. | G09F 7/16 428/14 |
| 12,402,735 | B1 * | 9/2025 | Webber | A47F 11/10 |
| 2009/0014105 | A1 | 1/2009 | Shattuck | |
| 2021/0022467 | A1 * | 1/2021 | Cox | A45C 13/1069 |
| 2021/0130049 | A1 | 5/2021 | Kramp et al. | |
| 2023/0218979 | A1 * | 7/2023 | Lee | A63F 1/062 273/148 A |
| 2025/0185774 | A1 * | 6/2025 | Elcano | A45C 11/18 |

FOREIGN PATENT DOCUMENTS

WO 2023086123 A1 5/2023

* cited by examiner

*Primary Examiner* — Jacob K Ackun
(74) *Attorney, Agent, or Firm* — Dunlap Bennett & Ludwig PLLC

(57) ABSTRACT

A case for a flat collectible item. The case provides pivotably coupled front and rear pieces that move between an open condition and a closed condition encasing the collectible item in a card recess. The card recess provides flared corners to prevent damage to the encased collectible item. The front and rear pieces each have exterior surface that provide stacking ridges that are uniformly offset from their respective perimeters so that when a first case is stacked on a second case, the front stacking ridge of the first case circumscribes the second rear stacking ridge of the second case, preventing or restricting lateral shifting of the stacked cases.

13 Claims, 20 Drawing Sheets

PROTECTIVE CASE FOR A COLLECTIBLE CARD

CROSS-REFERENCE TO RELATED APPLICATION

This application claims the benefit of priority of U.S. provisional application No. 63/492,308, filed 27 Mar. 2023, the contents of which are herein incorporated by reference.

BACKGROUND OF THE INVENTION

The present invention relates to long-term storage and protection of flat collectibles items and, more particularly, a protective case for a collectible card.

A collectible card (or trading card) is a small rectangular card, usually made from paperboard or thick paper, which usually contains an image of a certain person, place, or thing (fictional or real) and a short description of the picture, along with other text (attacks, statistics, or trivia). There is a wide variation of different types of collectible cards that include trading cards associated with sports figures to cartoons, comic book characters, television series and film stills, as well as other subjects such as Pokémon™ and other non-sports trading cards, and even cards designed specifically for playing fantasy-based games.

Hobbyists and investors desire to keep these collectible cards in the best condition possible because the difference in market value of otherwise identical collectible cards is fully dependent upon their physical conditions. Transparent flat plastic cases are traditionally used to preserve a collectible card's physical condition in the long term. Moreover, the organization of a collection of many collectible cards, as well as the appraisal and authentication of each card, involves the physical association of the collectible card with an indicia label. The above-mentioned cases, typically called slab cases, further provide for incorporation of the indicia label within the case.

Where current protective storage cases for collectible cards fall short, however, is one or more of the following disadvantages: no structure inherent to the card case that facilitates the stacking of a plurality of card cases, no feature to facilitate removing an encased card, and, among other things, no feature to facilitate proper application of a tamper-proof seal or sticker.

As can be seen, there is a need for a protective case for a collectible card featuring dual magnet clasps, ridges around the border for stacking, finger slot for card removal, header for label options and areas for top middle of front and back to add seal/sticker.

SUMMARY OF THE INVENTION

In one aspect of the present invention, case for encasing a flat collectible item, the case includes the following: a front piece having a front exterior surface and an opposing front interior surface, wherein the front interior surface is uniformly and continuously planar but for two front connection points and a front pinch notch, the front piece further providing: two prongs projecting from a lower front latitudinal edge of the front piece; and a front stacking ridge offset, by a front offset distance, inward of a perimeter of the front exterior surface; and a rear piece having a rear exterior surface and an opposing rear interior surface, wherein the rear interior surface is uniformly and continuously planar but for two rear connection points, a rear pinch notch, a ledge, and a card recess, the rear piece further providing: a rear stacking ridge offset, by a rear offset distance, inward of a perimeter of the rear exterior surface; and two pivot points along the ledge, wherein the two prongs operatively associated with the two pivot points so that the front piece and the rear piece pivot relative to each other between an open condition and a closed condition wherein the front connection points and the rear connection points abut in facing juxtaposition.

In another aspect of the present invention, the case further includes wherein the front stacking ridge and the rear stacking ridge form a closed loop but for a front sealing zone and a rear sealing zone, respectively, and a front marking zone and a rear marking zone, respectively; further including a sealing sticker that extends between the front and rear sealing zones without contacting the rear and front stacking ridges; further including a magnetizable material in each connection hole for forming a magnetically locked engagement in the closed condition, wherein the front pinch notch communicates with the front interior surface and an upper front latitudinal edge of the front piece, and wherein the rear pinch notch communicates with the rear interior surface and an upper front latitudinal edge of the rear piece so that in the closed condition, the front pinch notch and the rear pinch notch abut in facing juxtaposition, wherein the ledge is adjacent a lower rear latitudinal edge of the rear piece, wherein the card recess provides a flared-out cutout at each corner of so that a flat collectible item confined in the card recess has a non-contacting relationship with recess edges that define the card recess, wherein a finger cutout is disposed along the recess edges wherein the finger cutout communicates with an upper edge of the flat collectible item confined in the card recess, wherein the finger cutout is partially hemispherical, wherein an interior-most surface of each prong is flush with the front interior surface, and wherein a label zone is defined by a recess in the rear interior surface.

In yet another aspect of the present invention, a second front stacking ridge of a second case contacts the rear exterior surface between the rear stacking ridge and the perimeter of the rear exterior surface when said case and the second case form a stacked arrangement wherein the second front stacking ridge and said rear stacking ridge restrain the respective lateral sliding of both said case and the second case.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

The user of directionally terms interior and exterior are in reference to the disclosed protective case in a closed condition which is further clarified through the below disclosure. Likewise, front, rear, longitudinal and latitudinal directional terms are defined by the orientation of a collectible card encased in the disclosed protective case in the closed condition.

Figure 1:
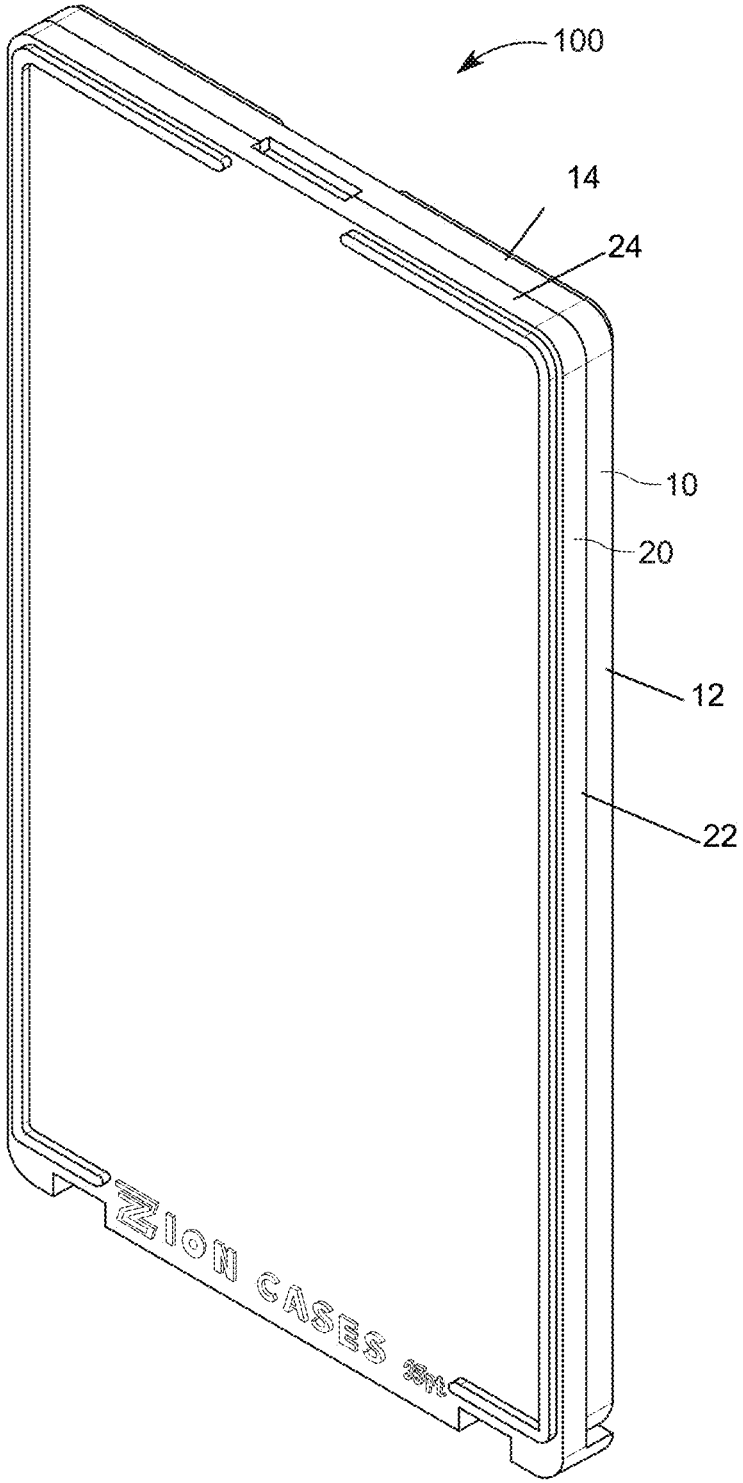
FIG. 1 is a top rear perspective view of an exemplary embodiment of a collectible case, shown in a closed condition.
Figure 5:
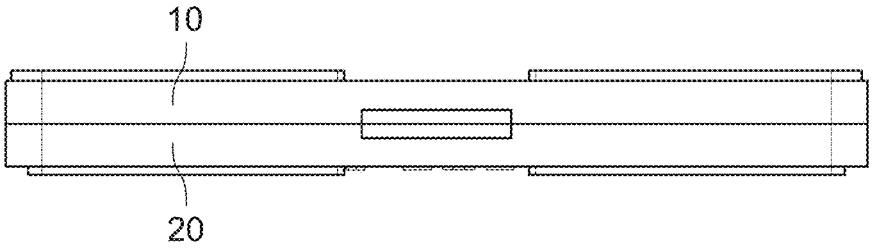
FIG. 5 is a top plan view of an exemplary embodiment of the collectible case, shown in the closed condition.
Figure 19:
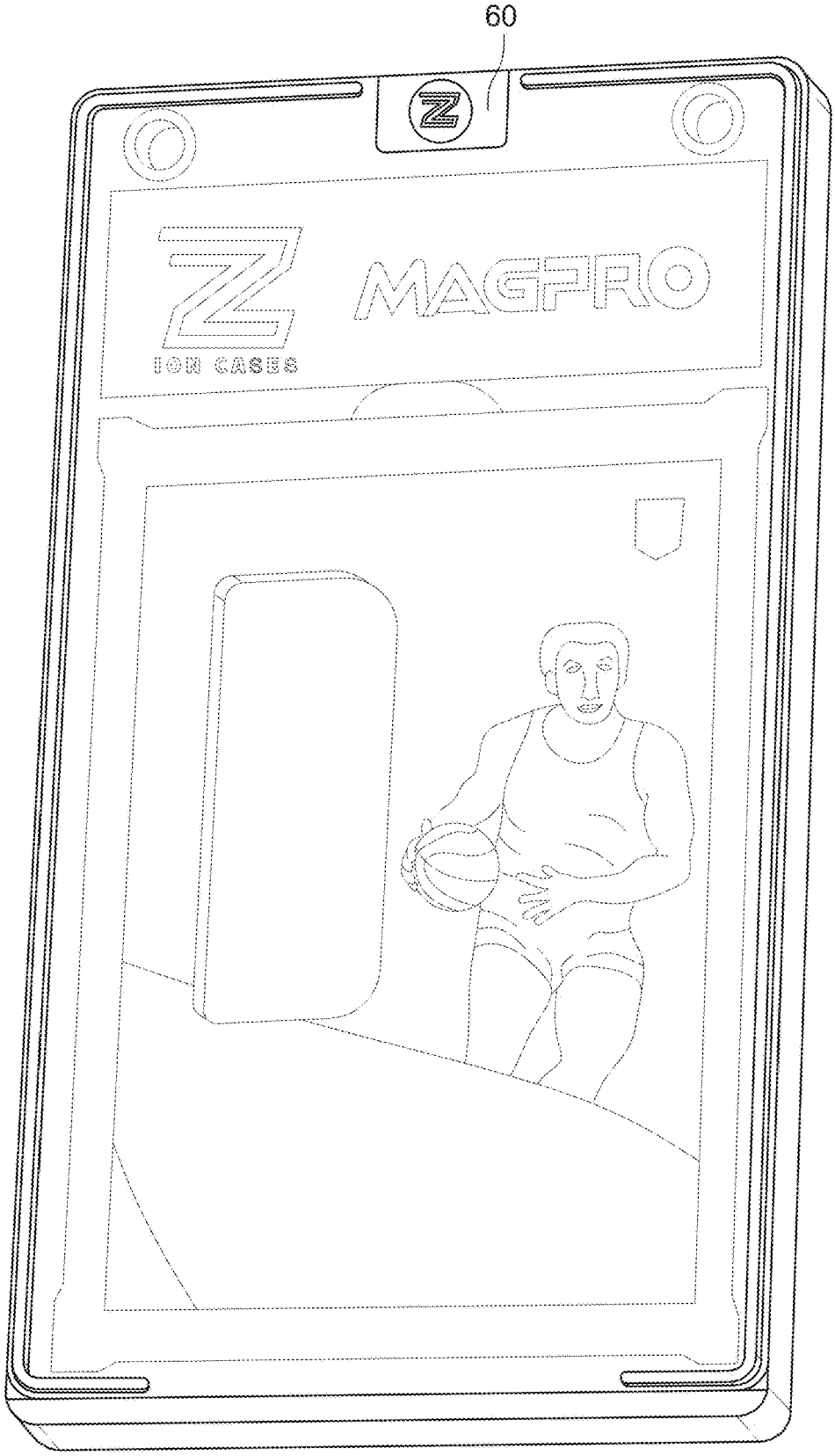
FIG. 19 is a front perspective view of an exemplary embodiment of the collectible case, shown in use encasing a collectible item in the closed condition.
Figure 20:
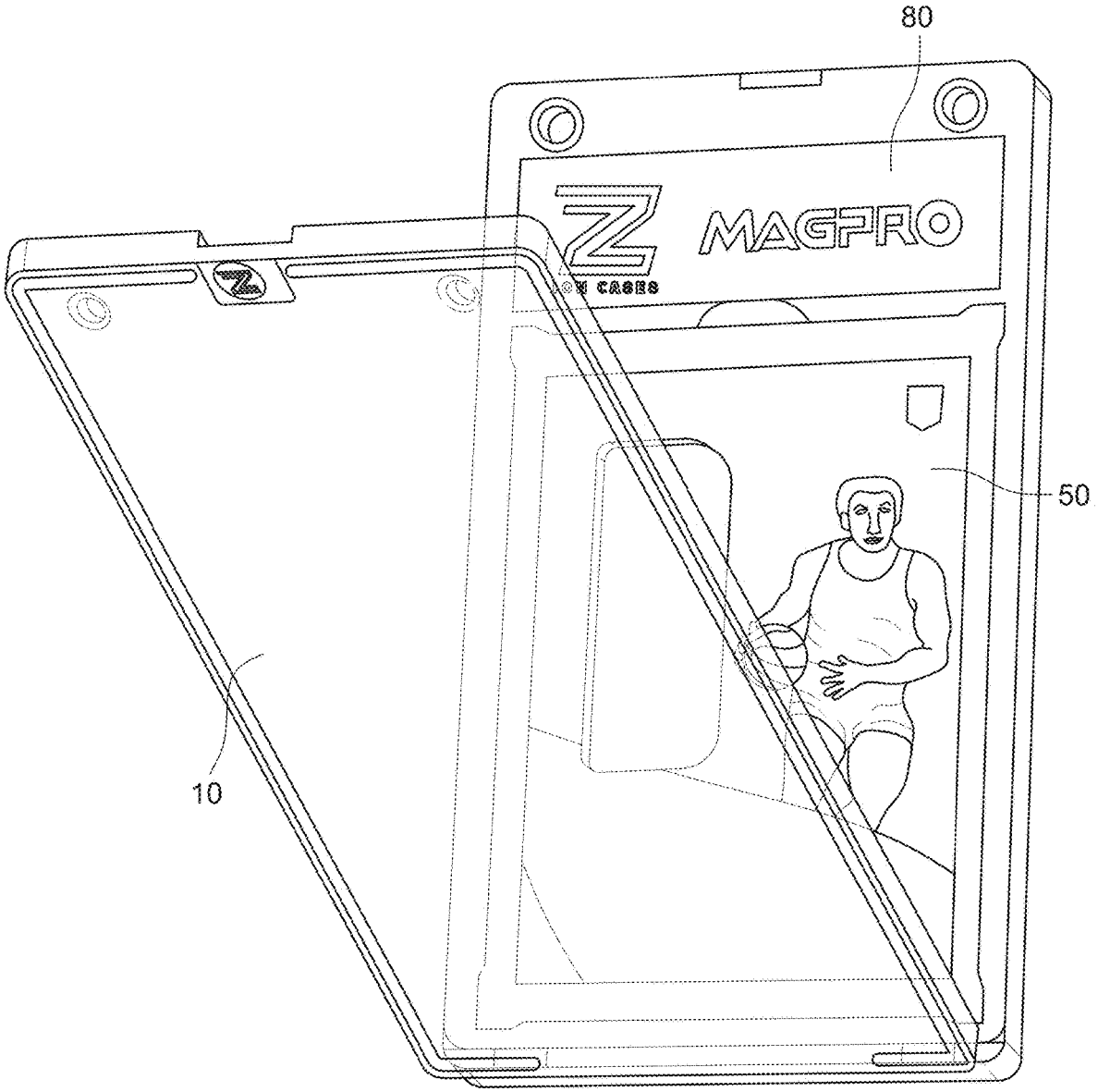
FIG. 20 is a front perspective view of an exemplary embodiment of the collectible case, shown in use in an open condition.

Referring to FIGS. 1 through 23, the present invention may include a collectible card protective case 100, as shown in FIG. 1 and FIG. 5, having a front piece 10 and rear piece 20 which operatively associated with each other so as to pivot between an open condition and a closed condition sandwiching therebetween a collectible card 50, the collectible card 50 is shown in FIG. 20.

Front and rear pieces 10 and 20 may be fabricated of transparent plasticized material or the like, which can be fabricated via molding, stamping, additive manufacture, or equivalent shaping methods. Front and rear pieces 10 and 20, respectively, are two different, separable pieces and each may have an elongated, planar rectangular perimeter defined by longitudinal edges 12/22 and latitudinal edges 14/24, respectively. Front piece 10 has opposing longitudinal edges 12 and opposing latitudinal edges 14. Rear piece 20 has opposing longitudinal edges 22 and opposing latitudinal edges 24, as seen on FIG. 1. The perimetral corners between a longitudinal edge and an associate latitudinal edge may be rounded.

Figure 2:
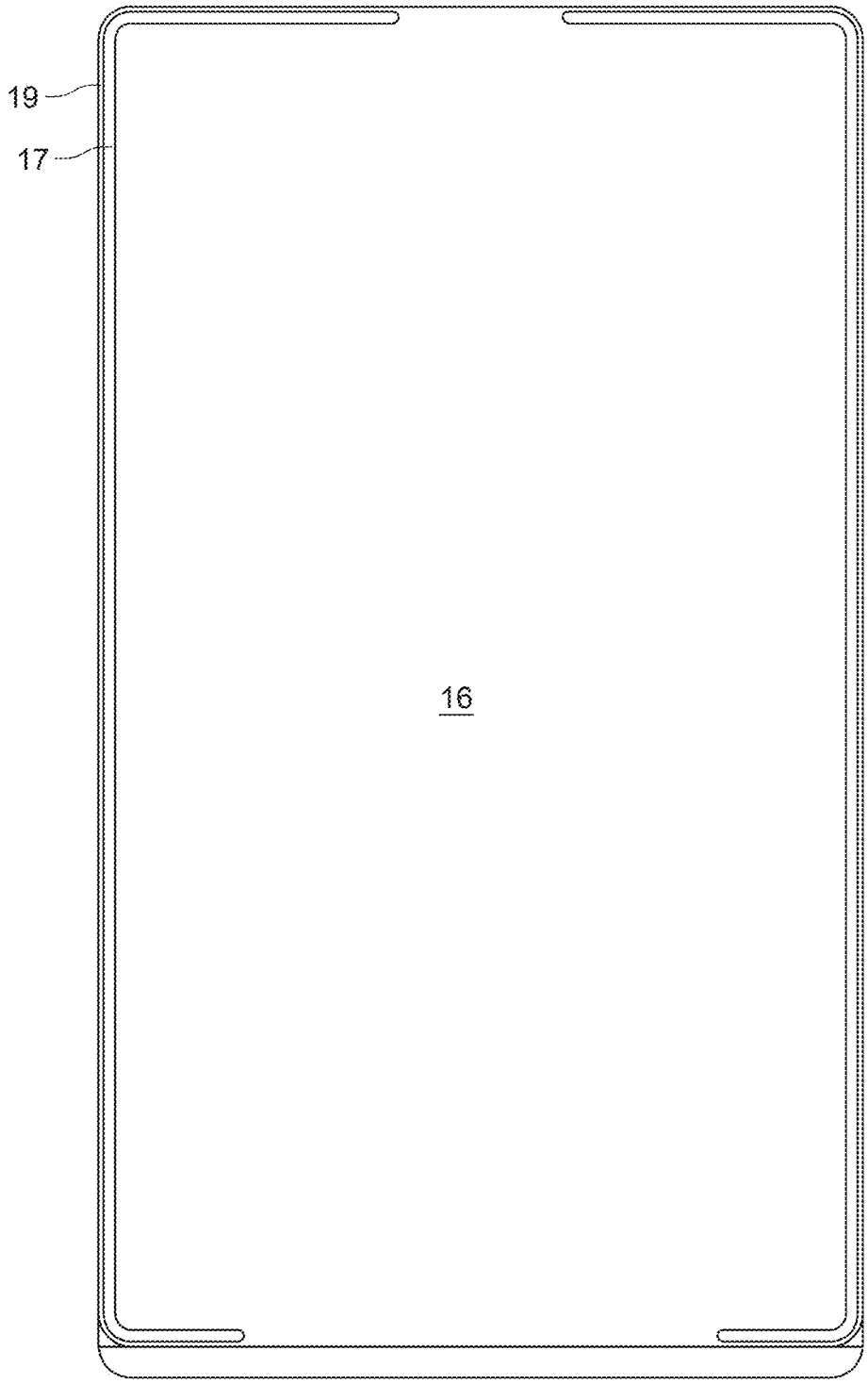
FIG. 2 is a front elevation view of an exemplary embodiment of the collectible case, shown in the closed condition.
Figure 3:
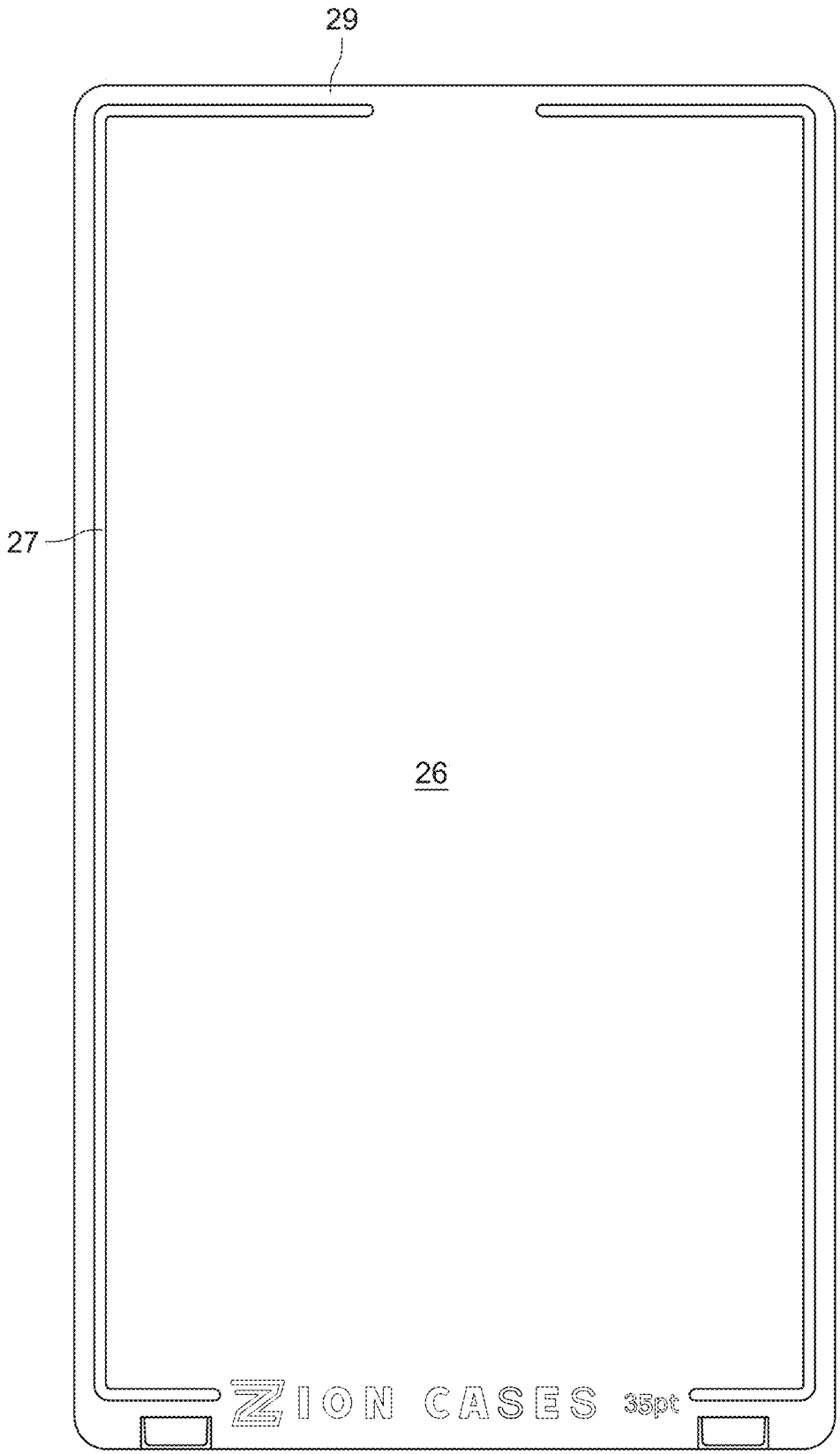
FIG. 3 is a rear elevation view of an exemplary embodiment of the collectible case, shown in the closed condition.
Figure 4:
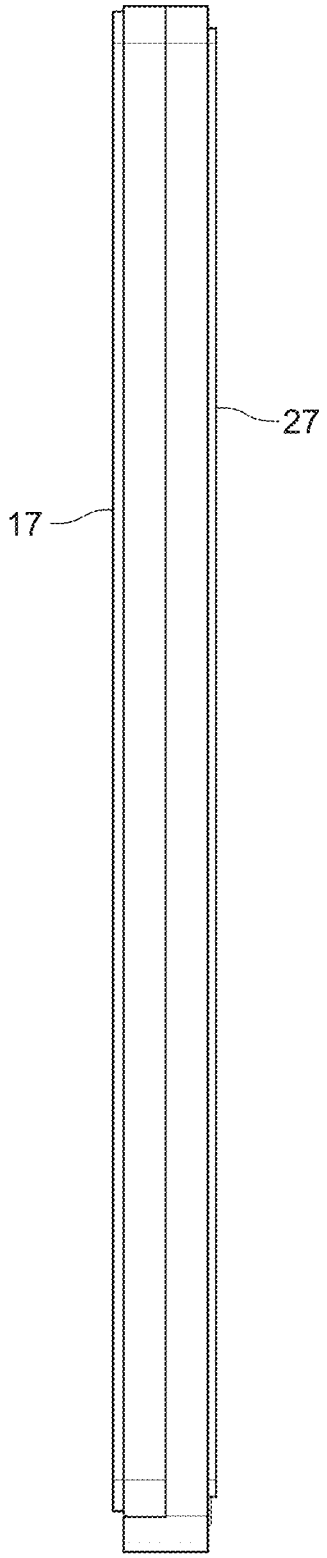
FIG. 4 is a right-side elevation view of an exemplary embodiment of the collectible case, shown in the closed condition.
Figure 8:
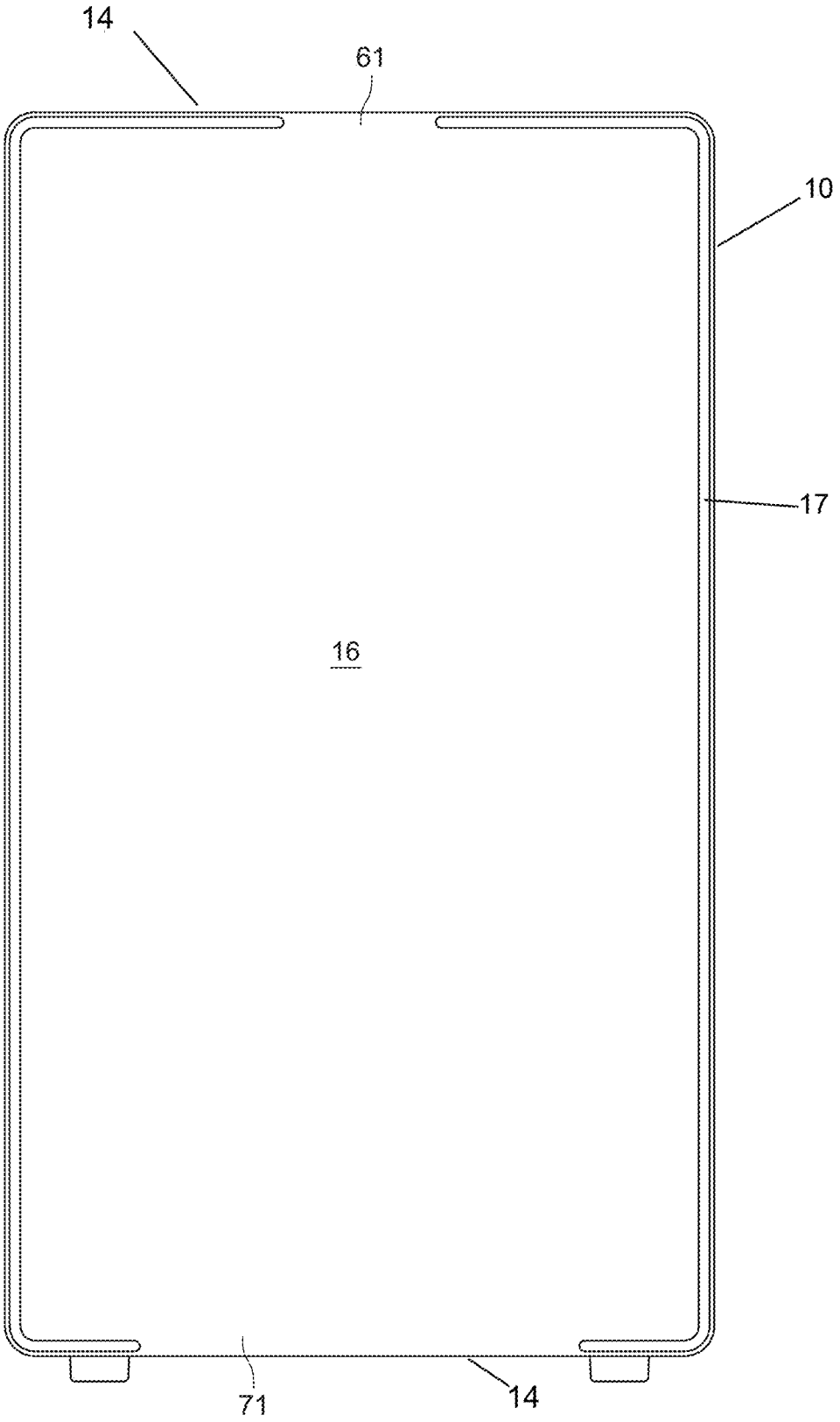
FIG. 8 is a front elevation view of an exemplary embodiment of the front piece of the collectible case, showing an exterior surface thereof.
Figure 9:
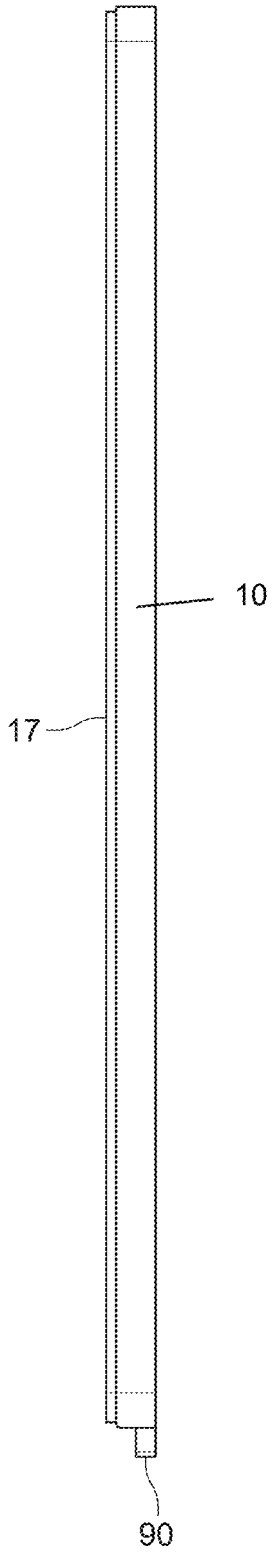
FIG. 9 is a right-side elevation view of an exemplary embodiment of the front piece of the collectible case.

The exterior face 16, when in the closed condition of the front piece 10, is uniformly and continuously flat but for a front stacking ridge 17 that orthogonally projects from this exterior face 16, as seen in FIGS. 2, 8 and 9. The front stacking ridge 17 may be uniformly spaced apart from the perimetral edge by a front offset distance or region of approximately 0.5 to 1.5 millimeters (mm). The front stacking ridge 17 may be cuboidal with a latitudinal width of approximately 1.15 mm and protrude approximately 0.8 mm from the exterior face 16. Front stacking ridge 17 may be interrupted at a front sealing zone 61 centrally disposed adjacent to the upper latitudinal edge 14 and a front marking zone 71 centrally disposed adjacent the lower latitudinal edge 14, as seen in FIG. 8.

Figure 6:
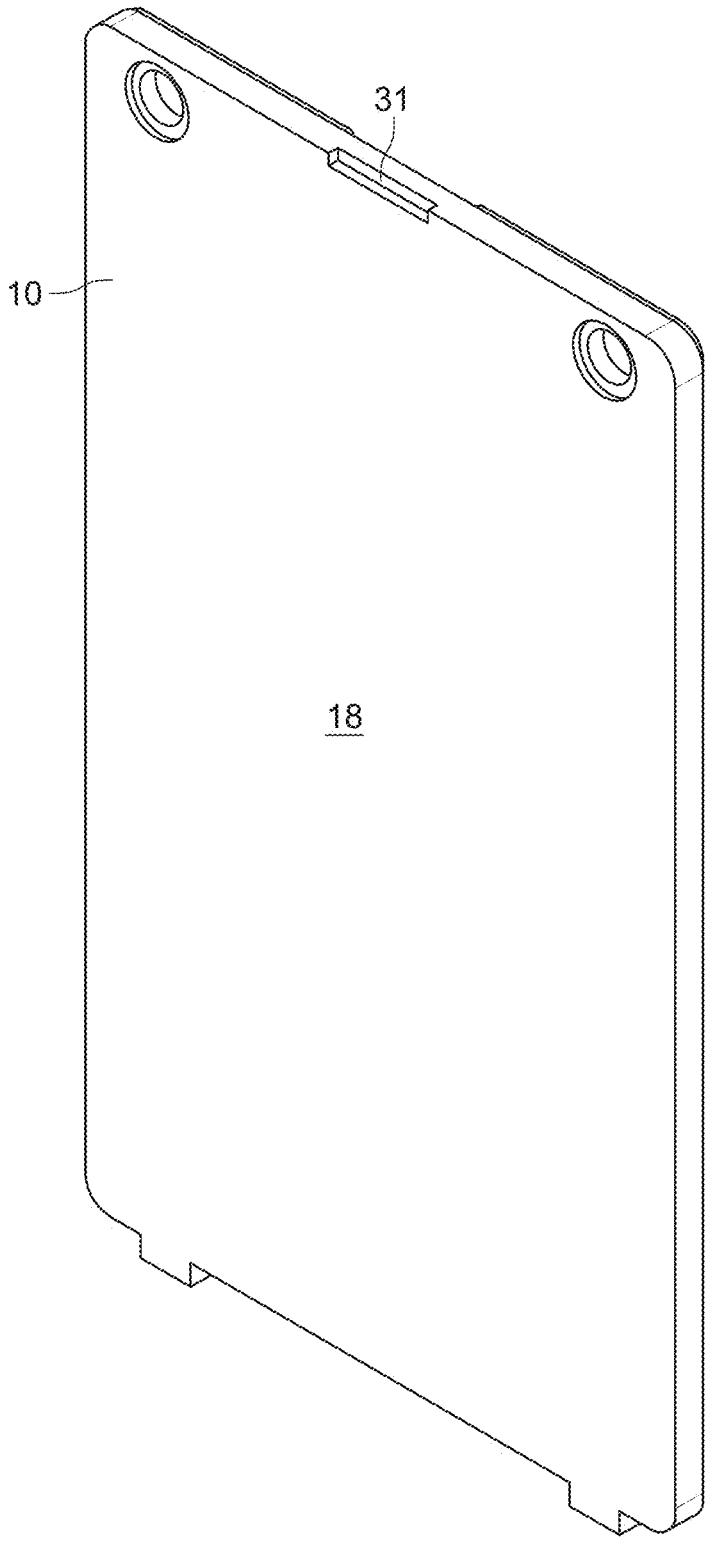
FIG. 6 is a top rear perspective view of an exemplary embodiment of a front piece of the collectible case, showing an interior surface thereof.
Figure 7:
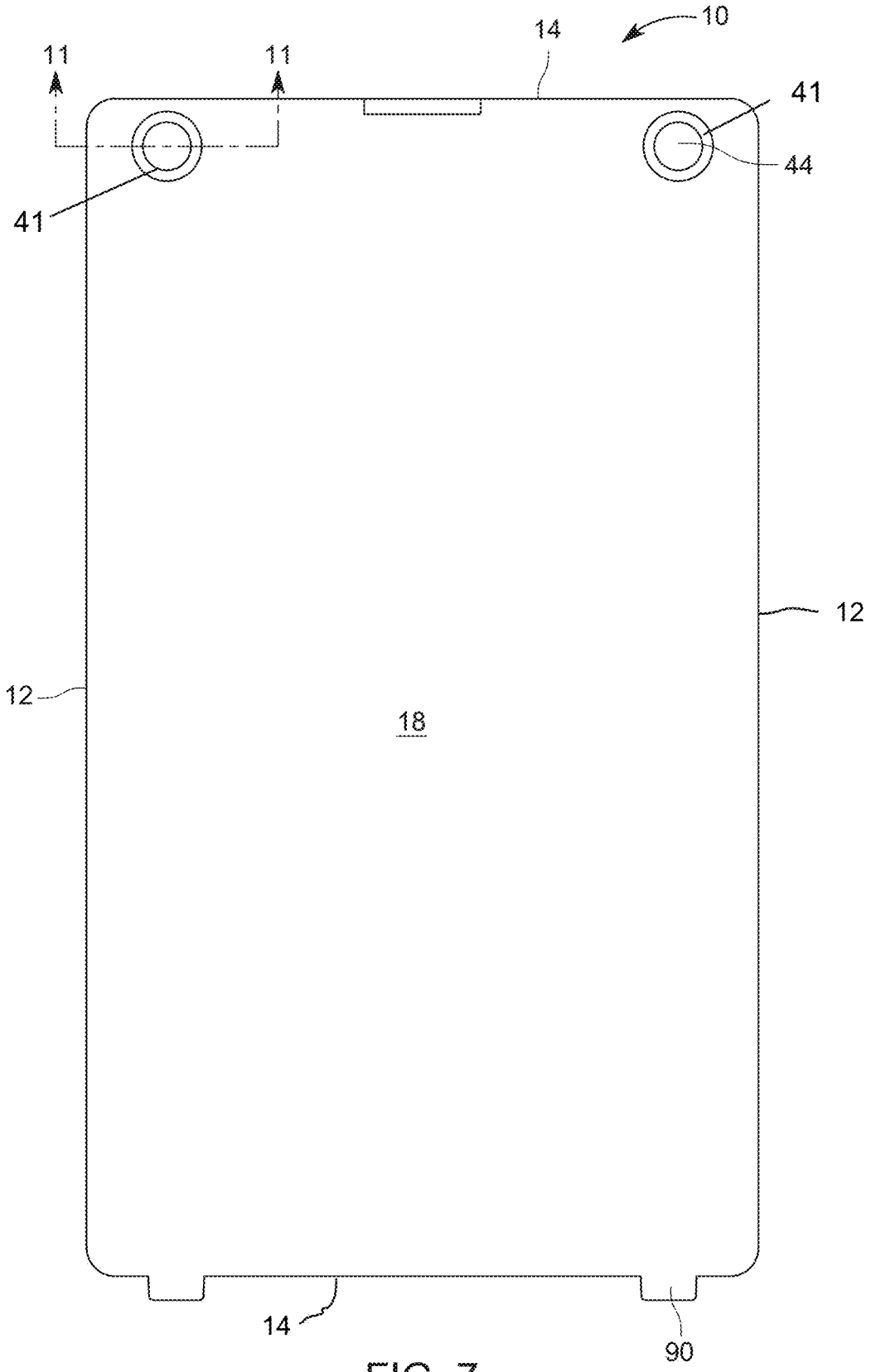
FIG. 7 is a rear elevation view of an exemplary embodiment of the front piece of the collectible case, showing the interior surface thereof.
Figure 10:
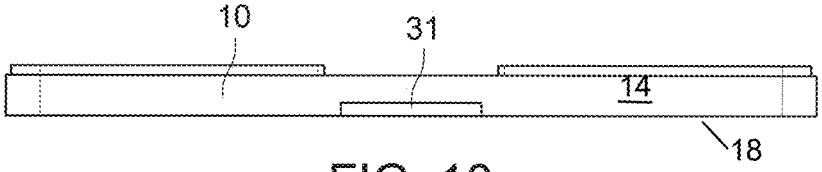
FIG. 10 is a top plan view of an exemplary embodiment of the front piece of the collectible case.
Figure 11:
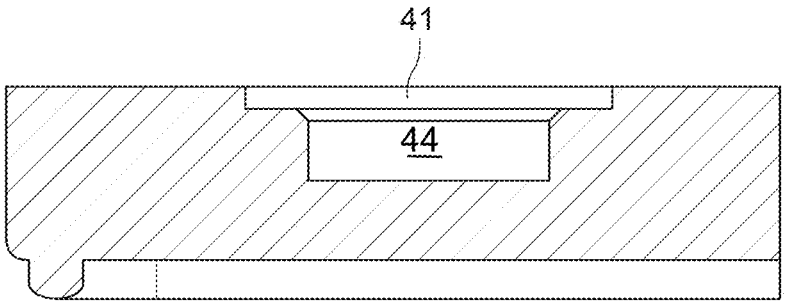
FIG. 11 is a section view of a front connection point of the collectible case, taken along line 11-11 in FIG. 7.

The interior face 18, when in the closed condition of the front piece 10, is uniformly and continuously flat but for a front pinch notch 31, see FIG. 6, and a plurality of front connection holes 41, see FIG. 7. The front pinch notch 31 is a recess that communicates the interior face 18 and the adjacent upper latitudinal edge 14, as seen in FIG. 10. The front pinch notch 31 may have a latitudinal width of approximately 12.5 to 13.0 mm, and a depth (from the interior face into the perimetral edge 14 of approximately 1.2 mm. Each front connection hole 41 may be occupied by a magnetizable material 44, see FIG. 11, so that, in some embodiments, an interior-most surface of the magnetizable material 44 is flush with the interior face 18 of the first piece 10.

Referring to FIG. 7, two pivot prongs 900 may project approximately 2.5 mm longitudinally downward from a lower latitudinal edge 14 [2] of the front piece 10. The pivot prongs 90 may have an interior-most surface that is flush with the interior face 18, but the pivot prongs 90 may have an exterior surface that is interior of the exterior face 16.

Figure 14:
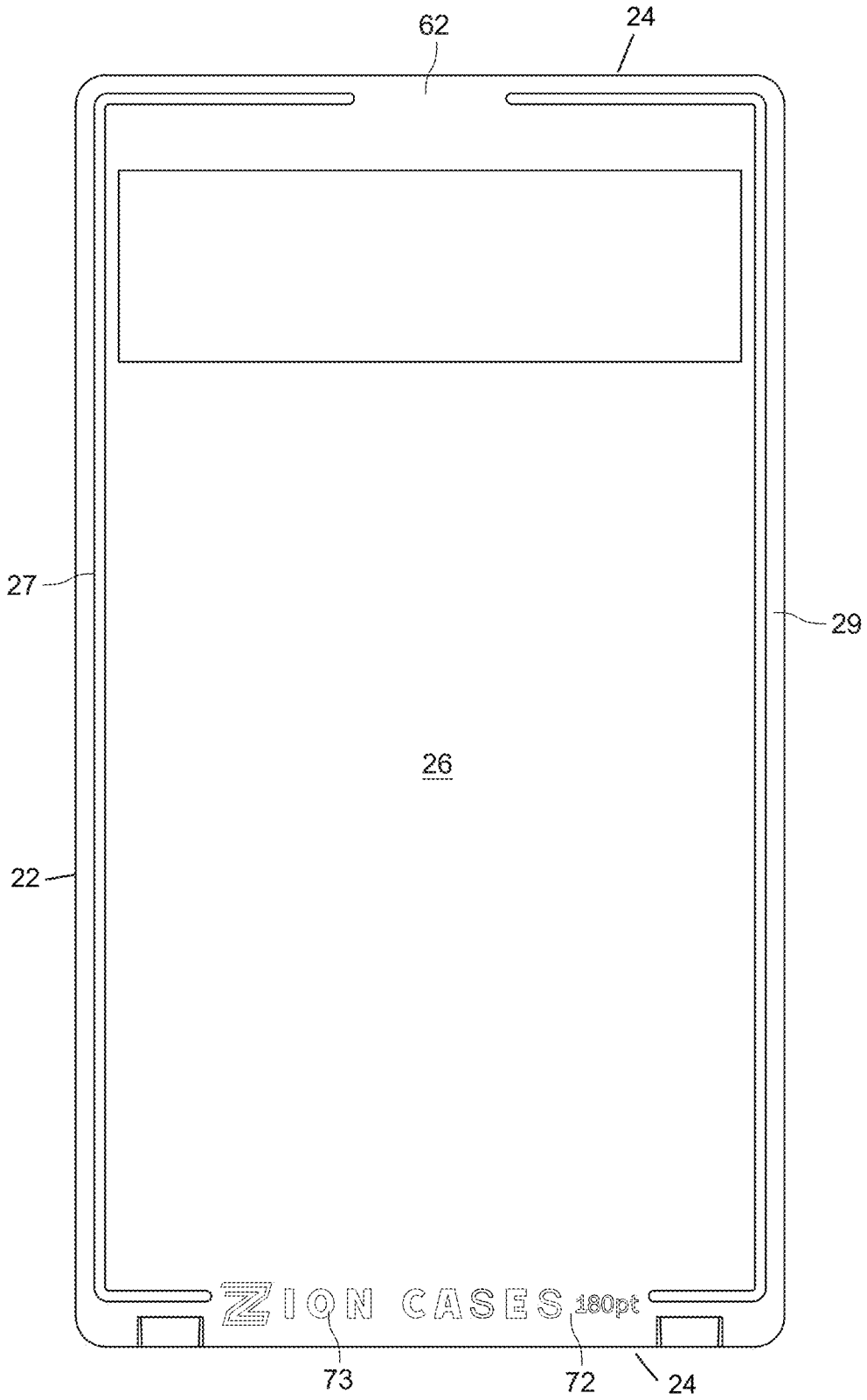
FIG. 14 is a front elevation view of an exemplary embodiment of the rear piece of the collectible case, showing an exterior surface thereof.

Regarding the rear piece 20, the exterior face 26 thereof, when in the closed condition, is uniformly and continuously flat but for a rear stacking ridge 27 that orthogonally protrudes or projects from this exterior face 26, as seen in FIG. 14. The rear stacking ridge 27 is uniformly spaced apart from perimetral edge by a rear offset of approximately 1.5 to 2.0 mm, thereby defining a rear offset region 29 greater than a front offset region 19 of the exterior face 16 of the front piece 10, see FIGS. 3 and 4. The rear stacking ridge 27 may be cuboidal with a latitudinal width of approximately 1.15 mm and protrudes approximately 0.8 mm from the exterior face 26. Rear stacking ridge 27 may be interrupted by a rear sealing zone 62 centrally disposed adjacent the upper latitudinal edge 24 and a rear marking zone 72 centrally disposed adjacent the lower latitudinal edge 24. The marking zone 72 may be used for placement of a trademark 73.

Figure 21:
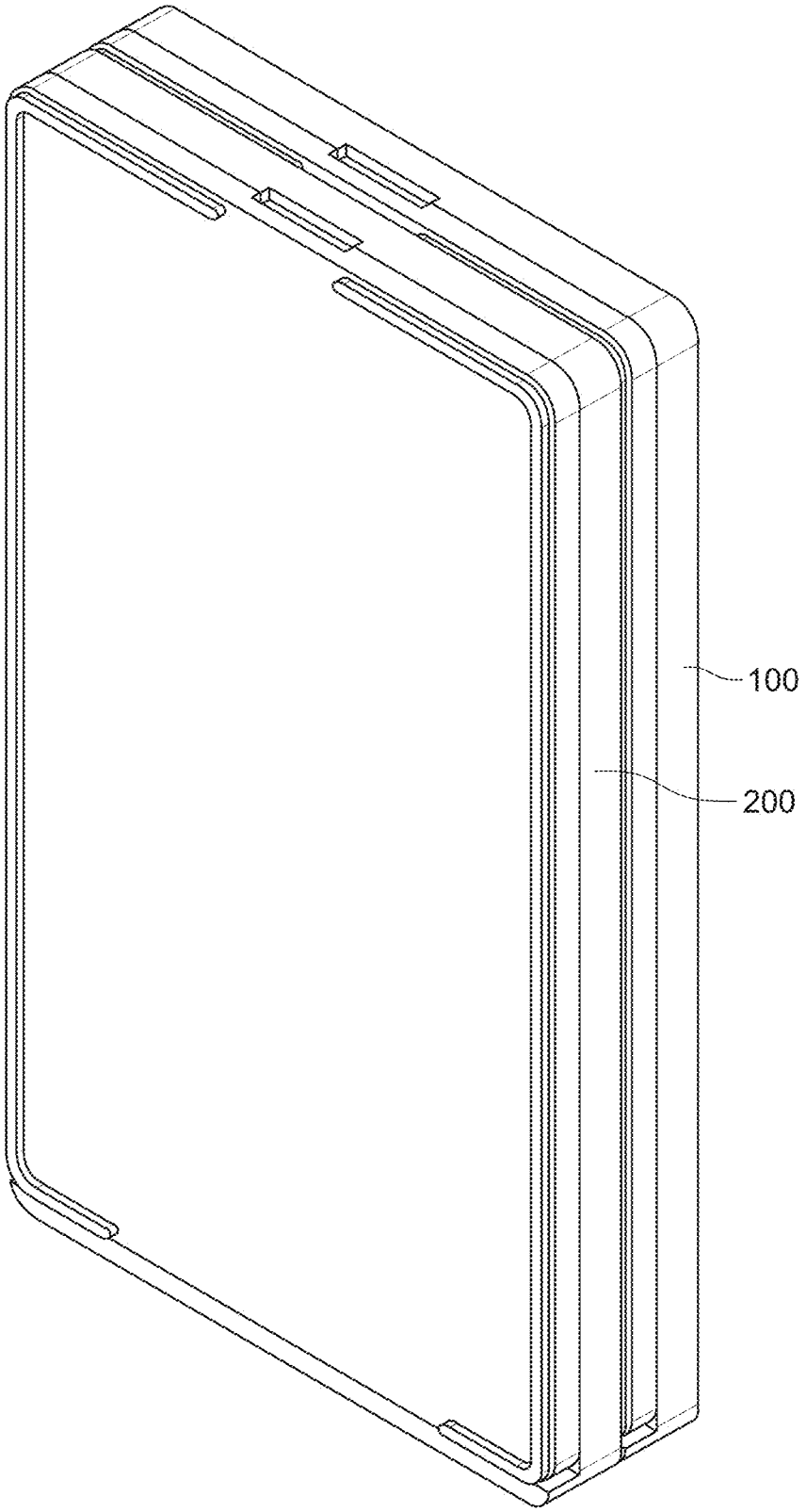
FIG. 21 is a front perspective view of an exemplary embodiment of two collectible cases, shown in a stacked arrangement.
Figure 22:
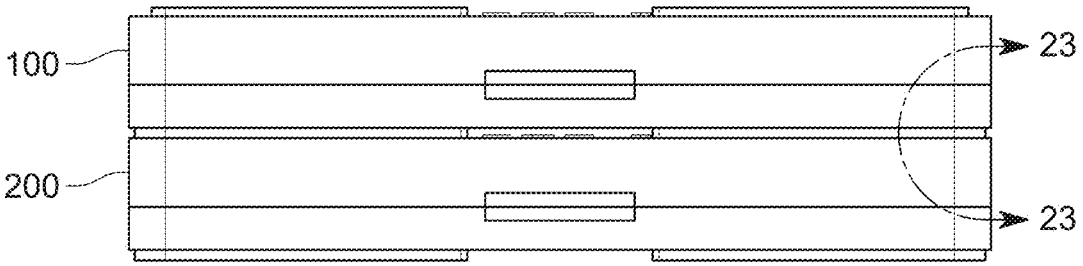
FIG. 22 is a top plan view of an exemplary embodiment of two collectible cases, shown in the stacked arrangement.
Figure 23:
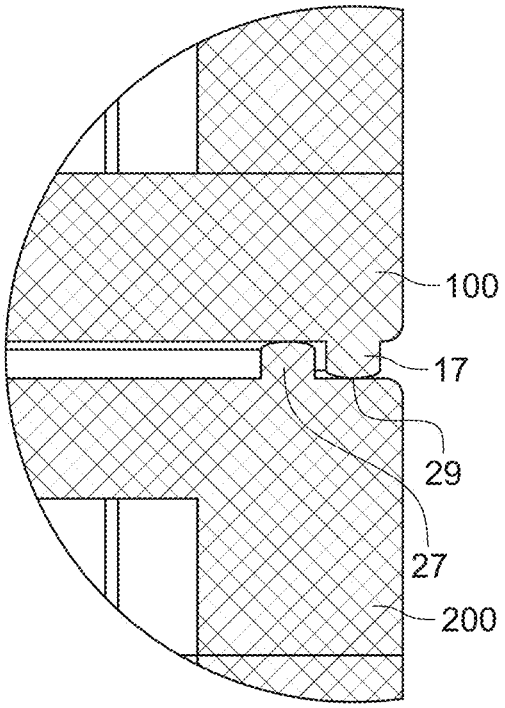
FIG. 23 is a section view of the stacked arrangement of the two collectible cases, taken along line 23-23 in FIG. 22, wherein the front stacking ridge of the first collectible case circumscribes the rear stacking ridge of the second collectible cases, thereby the engaged slacking ridges restrict the movement of the two collectible cases in all lateral directions coplanar with their exterior and interior faces shown.

The front and rear stacking ridges 17 and 27 are offset inward from their respective perimetral edges by a front and rear offset, respectively, thereby enabling a front stacking ridge 17 to circumscribe, snugly or otherwise, a rear stacking ridge 27 of another case 200 aligned and positioned in a stacked relationship against the exterior face 16 of a first case 100, as illustrated in FIGS. 21, 22 and 23. In this stacked relationship, the front stacking ridge 17 of the first collectible 100 case engages or contacts the rear offset region 29 of the second case 200.

Figure 12:
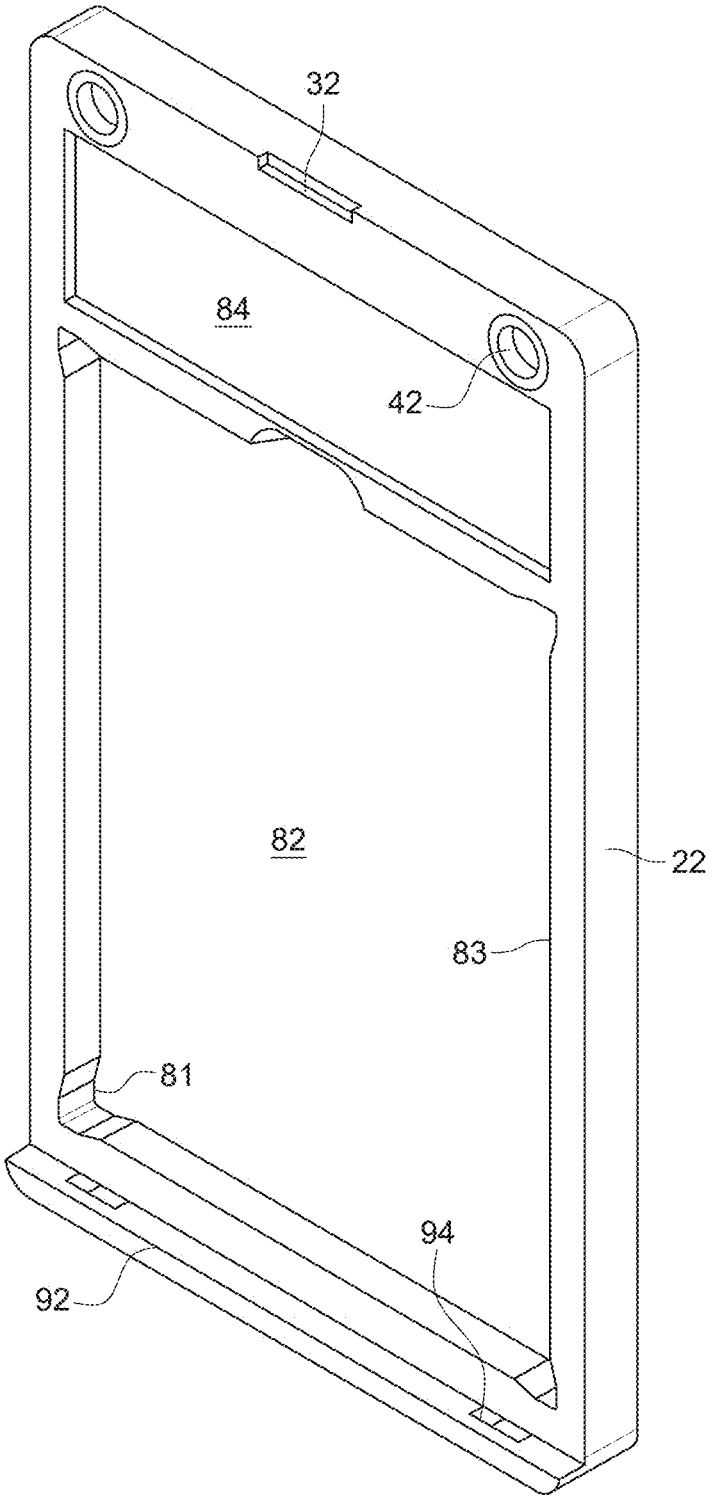
FIG. 12 is a top rear perspective view of an exemplary embodiment of a rear piece of the collectible case, showing an interior surface thereof.
Figure 13:
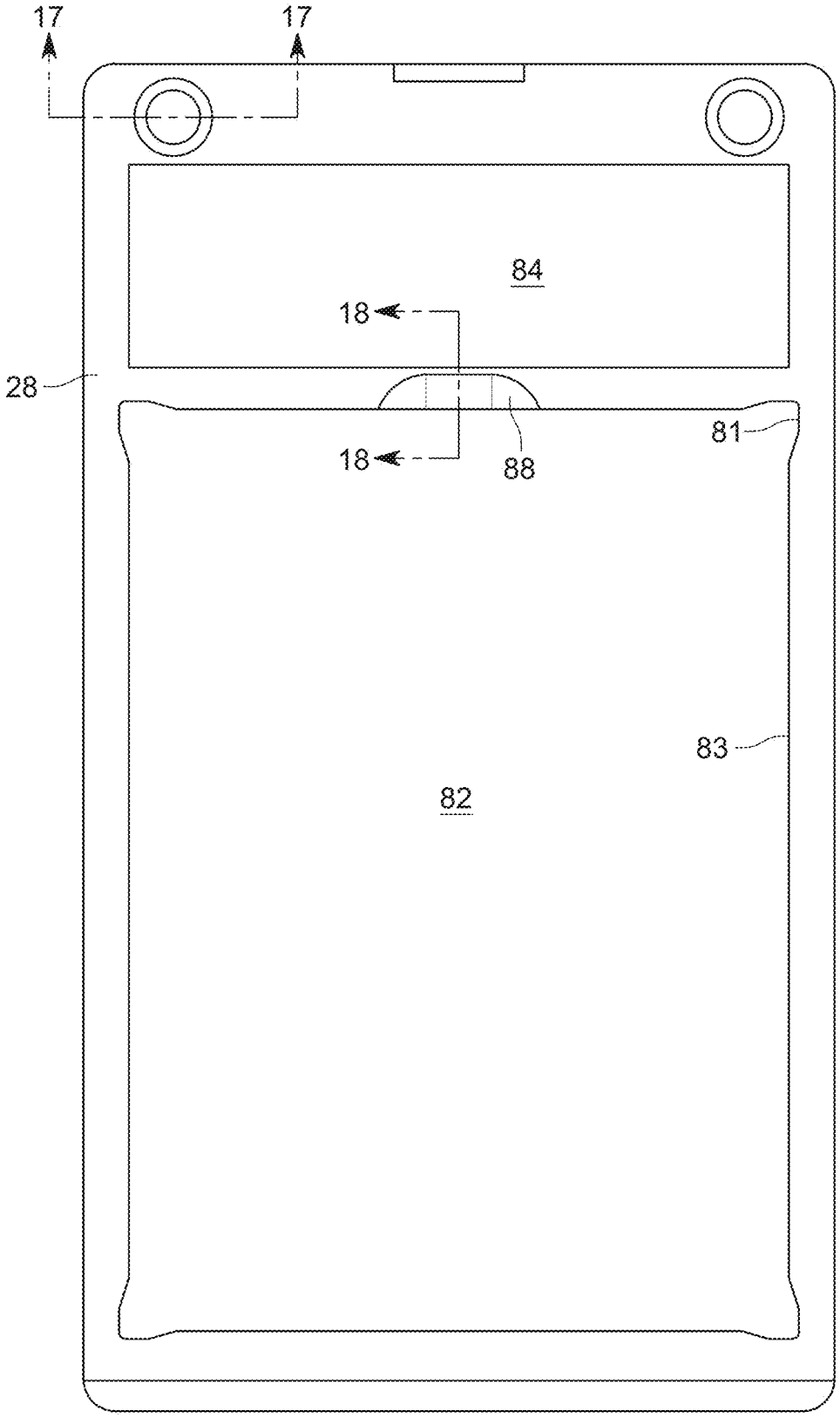
FIG. 13 is a rear elevation view of an exemplary embodiment of the rear piece of the collectible case, showing the interior surface thereof.
Figure 16:
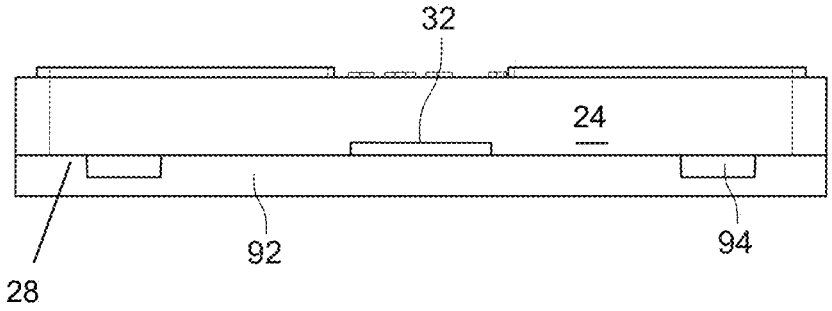
FIG. 16 is a top plan view of an exemplary embodiment of the rear piece of the collectible case.
Figure 17:
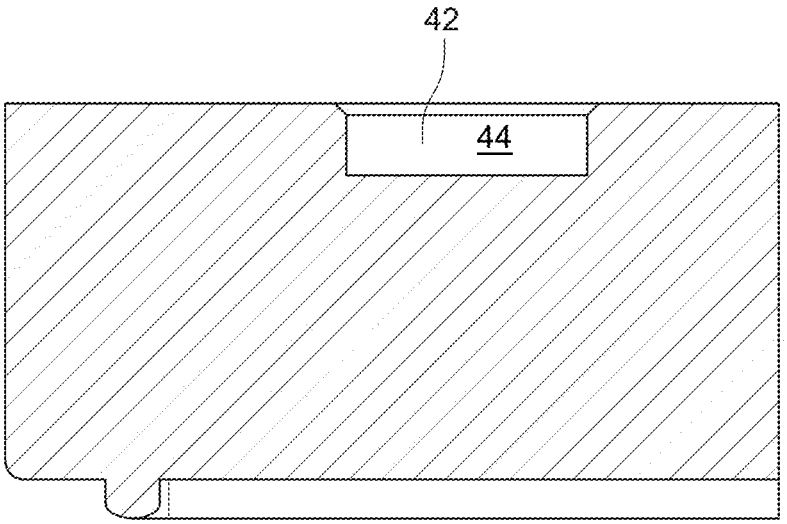
FIG. 17 is a section view of a rear connection point of the collectible case, taken along line 17-17 in FIG. 13.

Interior face 28 of the rear piece 20 may be uniformly and continuously flat but for a rear pinch notch 32 and a plurality of rear connection holes 42, see FIG. 12. The rear pinch notch 32 is a recess that communicates the interior face 28 and the adjacent upper latitudinal edge 24, as seen in FIG. 16. The rear pinch notch 32 may have a latitudinal width of approximately 12.5 to 13.0 mm, and a depth (from the interior face into the perimetral edge 14 of approximately 1.2 mm. Each rear connection hole 42, see FIG. 17, may be occupied by a magnetizable material 44 so that the interior most surface of the magnetizable material 44 is flush with the interior face 28.

Figure 15:
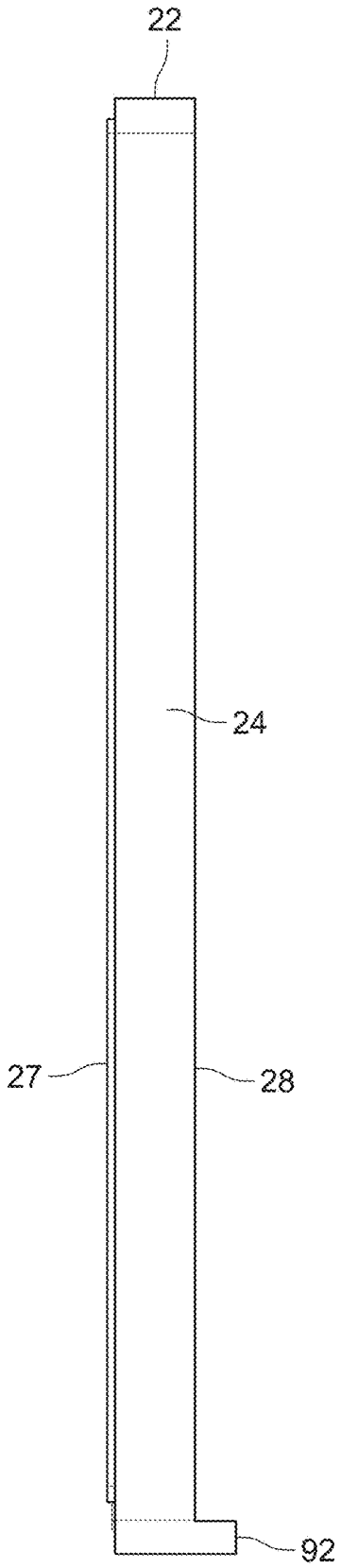
FIG. 15 is a left-side elevation view of an exemplary embodiment of the rear piece of the collectible case.

Projecting interior of the interior face 28 may be a ledge 92 extending adjacent to the lower latitudinal edge 24, see FIG. 15. The ledge 92 may project approximately 3.6 mm. Ledge 92 may provide two spaced apart pivot holes 94 which are dimensioned and shaped so that the pivot prongs 90 simultaneously operatively associate therewith, thereby enabling the pivotal relationship between the front piece and the rear piece 20 for moving the collectible case 100 between the open condition (shown in FIG. 20) and the closed condition.

In the closed condition the front and rear connection holes 41, 42 align and form a magnetic connection by way of the respective magnetizable materials 44 whose respective interior-most surfaces abut in a facing juxtaposition. This magnetic connection may be undone, in part, by the space afforded the interface of the front and rear pinch notches 31 and 32 in the closed condition.

Also along the interior face 28 is a card recess 82 and, spaced apart therefrom, a label zone 84. The card recess 82 is dimensioned and shaped to confine a collectible card 50 while permitting slight movement thereof between recess edges 83. Card recess 82 has an elongation axis parallel with the longitudinal edges 22. Each of the card recess 82 may provide a flared-out cutout 81, as seen in FIG. 12, which accommodates the corners of collectible card 50 in non-contacting relationship with the recess edges 83, which defines the remainder of the card recess 82. Since damaged corners can ruin the value of the collectible card 50.

The label zone 84 is dimensioned and shaped to receive an indicia label 80. The label zone 84 is adjacent to the upper latitudinal edge 24 and has an elongation axis parallel to the latitudinal edges 24. Depending on the size of case 100, the label zone 84 may be a recess into the interior face 28 (like the card recess 82) or just a demarked surface area of the interior face 28, see FIG. 13.

Figure 18:
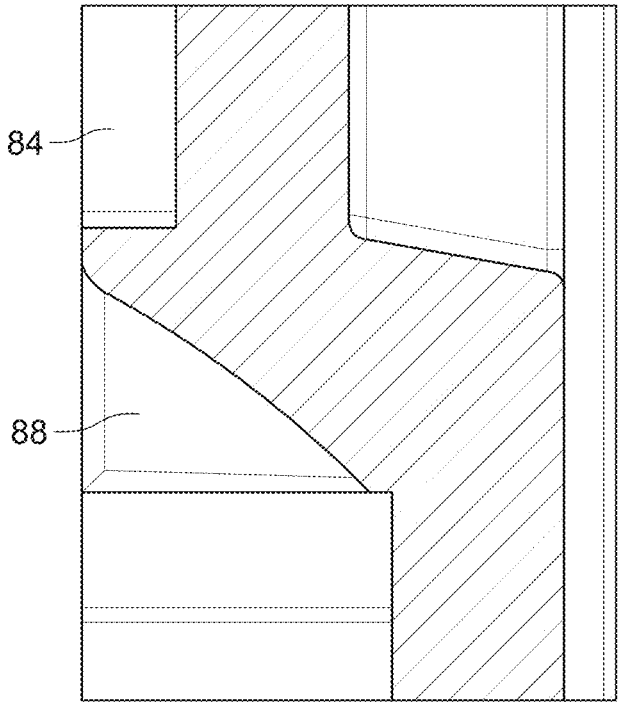
FIG. 18 is a section view of a finger recess of the collectible case, taken along line 18-18 in FIG. 13.

Disposed between the card recess 82 and the label zone 84 may be a finger recess 88 dimensioned and adapted to enable a user to finger the collectible card 50 out of the card recess 82. The finger cutout 88 may be arched or a substantial semi-circular shaped and have a partial spherical volume, as illustrated in FIG. 18.

Referring to FIG. 19, i the closed condition a seal 60 may wrap from the front seal zone 61 to the rear seal zone 62, thereby requiring movement to the open condition to rend asunder the seal 60, thereby providing unequivocal evidence of tampering. This tampering-proof seal 60, which adds security against tampering, may be sticker or the like. The tampering-proof seal 60.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affects the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A case for encasing a flat collectible item, the case comprising:

a front piece having a front exterior surface and an opposing front interior surface, wherein the front interior surface is uniformly and continuously planar but for two front connection points and a front pinch notch, the front piece further comprising:

two prongs projecting from a lower front latitudinal edge of the front piece; and a front stacking ridge offset, by a front offset distance, inward of a perimeter of the front exterior surface; and a rear piece having a rear exterior surface and an opposing rear interior surface, the rear piece further comprising:

a rear stacking ridge offset, by a rear offset distance, inward of a perimeter of the rear exterior surface; and two pivot points along a ledge along the rear interior surface, wherein the two prongs operatively associated with the two pivot points so that the front piece and the rear piece pivot relative to each other between an open condition and a closed condition wherein the front connection points and two rear connection points abut in facing juxtaposition.

2. The case of claim 1, wherein the front stacking ridge and the rear stacking ridge form a closed loop but for a front sealing zone and a rear sealing zone, respectively, and a front marking zone and a rear marking zone, respectively.

3. The case of claim 2, further comprising a sealing sticker that extends between the front and rear sealing zones without contacting the rear and front stacking ridges.

4. The case of claim 3, further comprising a magnetizable material in each connection hole for forming a magnetically locked engagement in the closed condition.

5. The case of claim 4, wherein the front pinch notch communicates with the front interior surface and an upper front latitudinal edge of the front piece, and wherein a rear pinch notch communicates with the rear interior surface and an upper front latitudinal edge of the rear piece so that in the closed condition, the front pinch notch and the rear pinch notch abut in facing juxtaposition.

6. The case of claim 5, wherein the ledge is adjacent a lower rear latitudinal edge of the rear piece.

7. The case of claim 6, wherein a card recess provides a flared-out cutout at each corner of so that a flat collectible item confined in the card recess has a non-contacting relationship with recess edges that define the card recess.

8. The case of claim 7, wherein a finger cutout is disposed along the recess edges wherein the finger cutout communicates with an upper edge of the flat collectible item confined in the card recess.

9. The case of claim 8, wherein the finger cutout is partially hemispherical.

10. The case of claim 9, wherein an interior-most surface of each prong is flush with the front interior surface.

11. The case of claim 10, wherein a label zone is defined by a recess in the rear interior surface.

12. The case of claim 1, wherein a second front stacking ridge of a second case contacts the rear exterior surface between the rear stacking ridge and the perimeter of the rear exterior surface when said case and the second case form a stacked arrangement wherein the second front stacking ridge and said rear stacking ridge restrain the respective lateral sliding of both said case and the second case.

13. The case of claim 10, wherein a trademark is disposed with a rear marking zone.

* * * * *